United States Patent [19]

Ward

[11] Patent Number: 4,824,076

[45] Date of Patent: Apr. 25, 1989

[54] CABLE WINCH WITH KICKER BAR

[75] Inventor: David L. Ward, Glasglow Pines, Del.

[73] Assignee: Research and Trading Corporation, Wilmington, Del.

[21] Appl. No.: 95,139

[22] Filed: Sep. 11, 1987

[51] Int. Cl.[4] ..... B66D 1/04

[52] U.S. Cl. ..... 254/384; 254/254

[58] Field of Search ..... 254/251, 252, 253, 254, 254/384

[56] References Cited

U.S. PATENT DOCUMENTS

| | | | |
|---|---|---|---|
| 459,033 | 9/1891 | Bolon | 254/246 |
| 702,648 | 6/1902 | Hand | 254/254 |
| 828,820 | 8/1906 | Lindley | 254/252 X |
| 974,258 | 11/1910 | Green | 254/246 |
| 1,151,670 | 8/1915 | Donald | 254/254 |
| 1,271,294 | 7/1918 | Duigan | 254/246 |
| 1,429,796 | 9/1922 | Stüttger | 254/245 |
| 1,443,064 | 1/1923 | Wilson | 254/254 |
| 3,341,177 | 9/1967 | Weise et al. | 254/246 |

FOREIGN PATENT DOCUMENTS

| | | | |
|---|---|---|---|
| 931689 | 6/1982 | U.S.S.R. | 254/254 |

*Primary Examiner*—Stuart S. Levy
*Assistant Examiner*—Katherine Matecki
*Attorney, Agent, or Firm*—Stephen F. K. Yee

[57] ABSTRACT

A cable winch having a pair of cable-gripping assemblies movably mounted on a support member adapted to be secured to a fixed point. An operating handle is pivoted to the support member, and linkages interconnect the handle with each of the assemblies to effect movement of the assemblies on the support member. A cable is winched by the assemblies alternately gripping, pulling, releasing and re-gripping the cable as the handle is operated. A kicker bar is pivotally supported adjacent to one of the gripping assemblies and coacts therewith to ensure that the movable gripping surface of the assembly positively releases its grip on the cable to ensure passage of the cable therethrough, while the remaining gripping assembly maintains its grip on the cable.

12 Claims, 2 Drawing Sheets

CABLE WINCH WITH KICKER BAR

BACKGROUND OF THE INVENTION

1. Field of the Invention

The present invention relates to cable pulling or winching devices, and to such devices of the type wherein operation of a handle causes separate gripping assemblies to alternately grip, release, move along the cable to re-engage and re-grip the cable. More particularly, the invention relates to such winching devices having means to ensure reliable release of one of the gripping assemblies.

2. Prior Art

A search of the prior art indicates the following U.S. Pat. Nos. may be pertinent to the present invention. U.S. Pat. Nos.:

459,033 Bolon
702,648 Hand
828,820 Lindley
974,258 Green
1,151,670 Donald
1,271,294 Duigan
1,443,064 Wilson
3,341,177 Weise et al.

Devices known as wire stretchers or tensioners are known in art which are used to pull a wire or cable to tension it prior to securing it to a support or to join it to another wire or cable. As used herein, the term "cable" will be used generically to refer to cables, wires or ropes which are used for substantially identical purposes. These wire stretchers generally include two or more cammed gripping elements, at least one of which is movable relative to a support member or the cable being tensioned. The stretcher is secured to a stationary point and the gripping elements are placed on the cable. Back-and-forth operation of a handle or lever causes the movable gripping element to slide along the cable, grip it securely and draw it toward the stationary point, release it, and repeat the process.

Generally, operation of the remaining gripping elements is coordinated to grip the cable when the movable gripping element has released it, and vice-versa, to maintain the cable under tension. In some of the known devices of this type, reliance is place upon the rigidity of the cable to separate the gripping surfaces to permit its passage through the gripping element which has slackened it grip. Devices of this type have been found not to operate reliably in heavy use with small cables or highly-flexible cables which tend to get bent or kinked, and thus jam the gripping elements.

Attempts to overcome these problems have resulted in devices of this type provided with linkages interconnecting the operating handle and the movable gripping surface of each gripping element. Movement of the handle in one direction causes the movable surface to separate from and release the cable in one of the gripping elements, and the movable jaw in the other element to grip the cable and draw it toward the stationary point to which the device is anchored. Movement of the handle in the other direction reverses operation of the gripping elements, and moves one of the gripping elements a distance along the cable for another grip. Usually a spring is provided for each gripping element to ensure that the cable is gripped when the operating handle is not moved.

For various reasons the devices of the prior art have not proven entirely satisfactory. Heretofore, devices of the foregoing type have not been provided with means to ensure that the gripping device which is to release its grip on the cable to permit passage of the cable therethrough, does in fact release its grip. The devices of the prior art have relied upon the interconnecting linkage to displace the cammed gripping surfaces and the stiffness of the length of wire extending between the gripping element, which is generally bowed or otherwise bend into a curved shape, to cause it to pass therethrough. As noted above, this mode of operation is satisfactory only if the cable is sufficiently stiff. Highly flexible cables, or cables of small diameter have not worked satisfactorily with the gripping devices of the foregoing type.

Additionally, since the cable length between the gripping element are bowed, the devices are subject to jamming or failure if the gripping element do not open to permit passage of the wire or cable, and the wire or cable is subjected to undue abrasion and wear, presenting a safety hazard requiring frequent inspection of the device and wire and cable, and more frequent replacement of the cable.

SUMMARY OF THE INVENTION

In view of the foregoing and other deficiencies of the prior-art devices, among the objects of the present invention are: to provide an improved cable winch provided with cable gripping elements which alternately grip and release the cable to casue passage of the cable through the winch; to provide a winch of the foregoing type having greatly-improved performance, reliability and reduced wear on the cable; to provide an improved winch of the foregoing type with means to reliably and consistently ensure the release of the cable and the passage of the cable through the winch; and to provide an improved winch of the foregoing type which is usable with cables and wires of any size and stiffness.

These and other objects of the invention are attained in the present invention wherein a cable winch is provided with a pair of cable gripping assemblies slidably mounted on a support member, each assembly having a movable cam surface biased against a cable-receiving channel. The support member is adapted to be secured to a fixed support. An operating handle is pivoted to the support member, and pairs of linkages interconnect the handle with each of the gripping assemblies to cause movement of each assembly along the support member by operation of the handle. A kicker bar is pivoted to the support member and operatively associated with the gripping assembly closest to the fixed support, to ensure that the movable cam surface is positively separated from the cable to permit the free passage of the cable therethrough which is being provided by the remaining gripping assembly.

DETAILED DESCRIPTION OF THE PREFERRED EMBODIMENT

Figure 1:
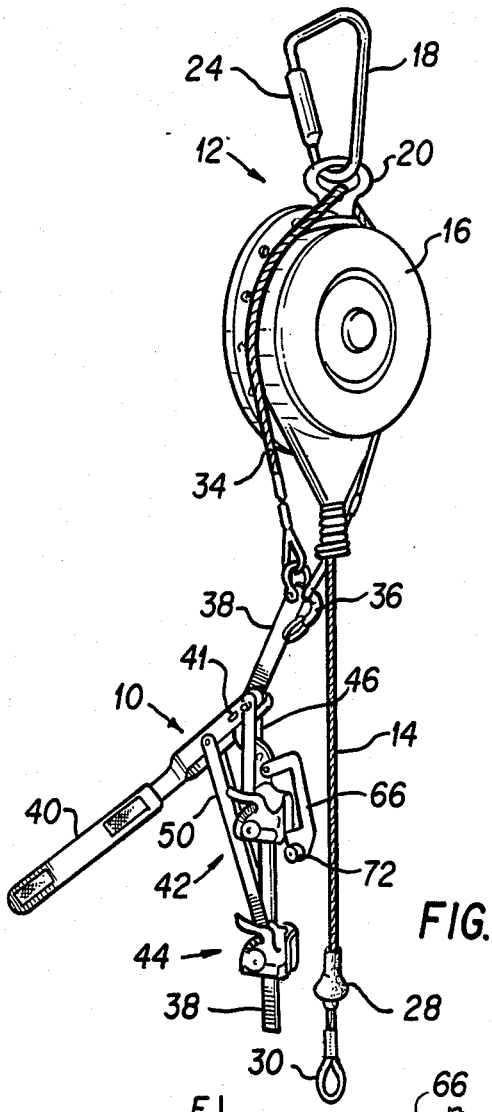
FIG. 1 is a perspective illustration of the improved winch of the present invention, ready for use with the cable with which it will be operatively associated.
Figure 3B:
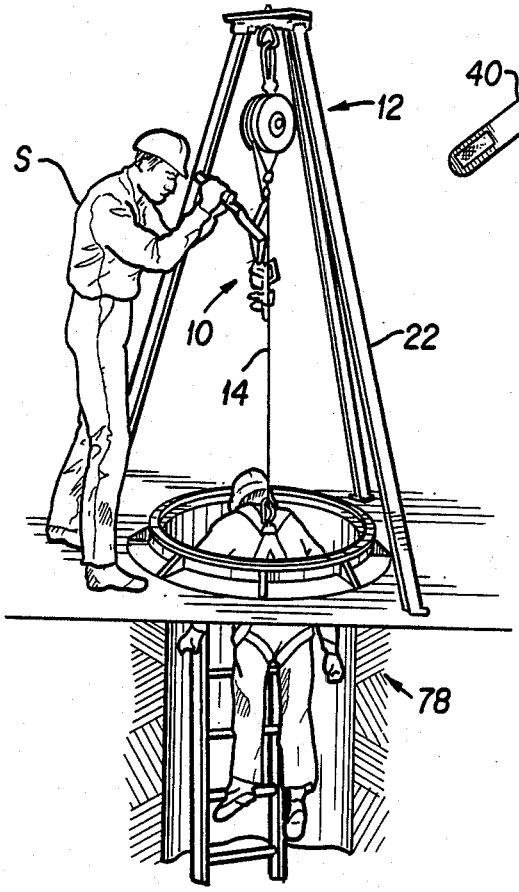

Referring now to the drawings, wherein the same or similar reference characters identify the same or similar elements throughout the several views, FIG. 1 shows the improved winch of the present invention, designated generally as 10, ready for use with a safety or fall prevention system 12. The following description of using the improved winch with a fall prevention system is provided for illustrative purposes only. The winch may be used in any appropriate manner or application where cable winching is desired.

The fall prevention system 12 tyipcally includes a length of high-strength cable 14 wrapped around a drum (not shown) rotatably mounted in a housing 16 and driven by a spiral spring (not shown) in a direction which continuously tends to wind the cable around the drum. A centrifugally-operated brake or clutch mechanism (not shown) in housing 16 responds to fast rotation of the drum in the unwinding direction to stop rotation of the drum to prevent further unwinding of the cable 14, thus arresting the fall of a person or object attached to the cable. Housing 16 is adapted to be suspended by a ring or hook 18 secured to a housing handle 20, from a fixed location, such as an elevated structure or a tripod 22 (FIGS. *3a,b*). Hook 18 may have the customary sleeve 24, spring biased and internally threaded, which is retractable to permit passage of the hook through handle 20 and a suspension ring 26 on tripod 22. The free end of cable 14 is provided with a stop 28 to prevent complete retraction into housing 16 and a loop 30 by which it is attached, for example, to a safety harness 32 worn by a person P.

Safety systems such as described above are known in the art, one of which is marketed under the name Retractalok by the assignee of the present invention.

Winch 10, secured to housing 16 by a support cable 34 wrapped around the housing and attached to the winch by a snap hook 36, includes an elongated slide bar 38 to which the support cable is attached, the slide bar being formed into a S shape at approximately its midpoint, and an operating handle or lever 40 pivotally supported on the slide bar, above the S bend. The gripping end of handle 40 is suitably roughened as at 40*a, b,* to provide a non-slip grip for the operator, and the opposite end of the handle is bifurcated to straddle slide bar 38 in the vicinity of the pivotal or fulcrum attachment 41 of the handle and slide bar, as shown in FIGS. 1, 2 and 4*a*–4*c*.

Slidably disposed on slide bar 38 are a pair of identical cable gripping devices 42 and 44. A pair of first links 46 interconnects gripping device 42, which for convenience will be referred to as the upper gripping device or upper device, with the bifurcated portions of handle 40 and is pivotally attached adjacent to the free ends of these handle portions, as at locations 48. A second pair of links 50 interconnects gripping device 44, which for convenience will be referred to as the lower gripping device or lower device, and the bifurcated portions of handle 40, as at locations 52. As shown in the drawings, the attachment locations 48 and 52 of links 46 and 50 are disposed on either side of the pivot location 41 of handle 40 and slide bar 38. Link pairs 46 and 50 are of unequal length to provide the appropriate vertical separation of gripping devices 42 and 44 on slide bar 38.

Figure 5:
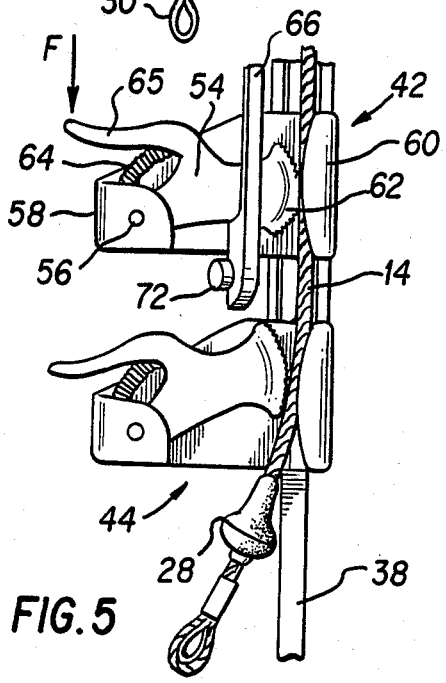
FIG. 5 shows a portion of the winch to a larger scale.

Since gripping devices 42 and 44 are structurally identical, the following description of the upper device 42 will apply equally to the lower device 44. As shown more clearly in FIG. 5, upper gripping device 42 includes a self-gripping cam or jaw 54 pivotally supported at 56 to a jaw housing 58 shaped at one end to provide the support 56 and shaped at the other end to form a channel or cable guide 60 for receiving a cable. The front of jaw housing 58 (as seen FIG. 5) is open to permit easy placement of the cable into the cable guide 60. The free end of jaw 54 is formed into an arcuate cam surface 62, which may be teethed or ribbed for increased gripping of the cable, biased into contact with cable guide 60 by a spring 64. Jaw 54 has a surface or trigger 65 extending away from pivot 56. Pressure F on trigger 65 rotates jaw 54 counterclockwise (as seen in FIG. 5) against the bias of spring 64, to separate cam surface 62 from cable guide 60 to permit insertion of cable 14 into the cable guide. Releasing pressure on the trigger permits the spring to force the cam surface against the cable.

While not shown in the drawings, the back surface of jaw housing 58 is provided with a tubular portion which receives slide bar 38 and slidably mounts gripping device 42 on the slide bar. Alternatively, the jaw housing can be shaped to provide a receiving portion for the slide bar.

The structure of gripping device 42 described thus far is known in the art, and the operation of the gripping device and cable winch are also known. The operation of the winch in conjunction with the improvement provided by the present invention, will be described more fully below.

Figure 2:
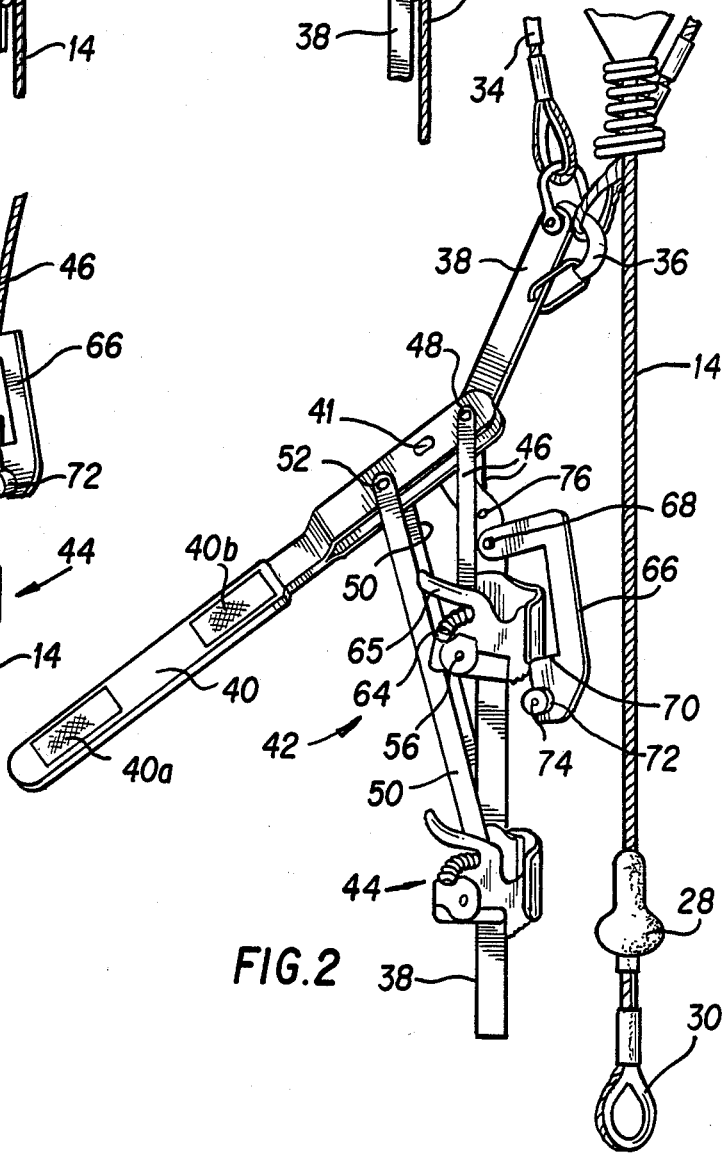
FIG. 2 is a view similar to FIG. 1, showing the winch to a larger scale.

Referring now to FIGS. 1 and 2 of the drawings, the kicker bar 66 is shaped element pivotally supported on slide bar 38 by a pin 68 located below the lower portion of the S bend of the slide bar. In frontal elevation, the shaped element forming the kicker bar resembles a modified "C", pivoted at the upper portion of the C. The lower portion of kicker bar 66, above the lower edge thereof, is provided with a horizontal straight edge 70 for engagement with the lower surface of gripping jaw 54, which continues into a vertical straight edge 71. A roller 72 is freely rotatable on a pin 74 secured adjacent to the lower portion of kicker bar 66. The diameter of roller 72 and the location of pin 74 are selected to permit a portion of the roller to extend beyond vertical edge 71 of kicker bar 66. As will be described more fully below, roller 72 serves to guide the lower portion of kicker bar 66 over the upper gripping device 42, and releases the kicker bar from jaw 54 after it has lifted the jaw from cable guide 60. Kicker bar 66 pivots freely about pivot pin 68, its upper rotational displacement being limited by a stop pin 76 fixed in slide bar 38.

Figure 3A:
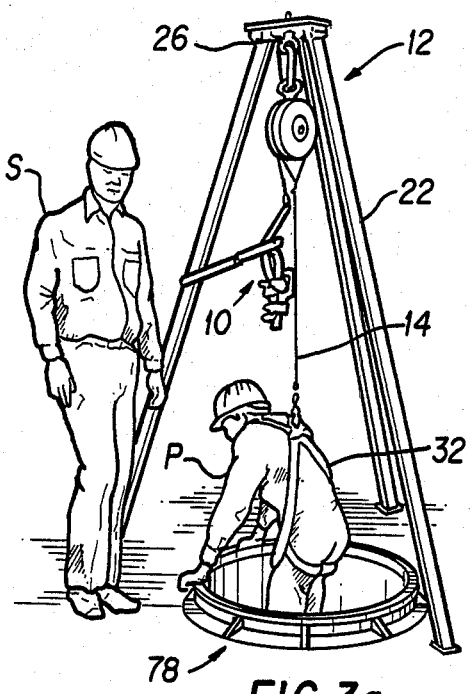
FIG. 3*a* and 3*b* illustrate one use of the winch to extricate a person from a confined space.

FIG. *3a–b* illustrate the use of the improved winch of the present invention to extricate an injured or otherwise disabled person from a confined space, such as manhole 78 shown in the drawings. Fall prevention system 12 is attached to and suspended from tripod 22 by retracting sleeve 24, passing ring 18 through the suspension ring 26 on the tripod, and resecuring the sleeve. Cable 14 is suitably attached to harness 32 worn by the person P entering the manhole. Winch 10 is supported from tripod 12 by support cable 34 being wrapped around housing 16 and fastened to slide bar 38 via snap hook 36. As shown in FIG. 3a, during normal or non-emergency situations, winch 10 remains suspended from housing 16 of fall prevention system 12, and is not connected to cable 14.

In the event it becomes necessary to use winch 10 to extricate an injured or disabled person, the winch is quickly coupled to cable 14 by the depressing the trigger portion 65 of the gripping jaw 54 for the upper and lower gripping devices 42 and 44, respectively. As shown in FIG. 5, the open configuration of these devices permits easy placement of cable 14 into cable guide channel 60 for each of the gripping devices when the respective gripping jaws are rotated counter-clockwise by depressing the trigger portion 65. With winch 10 coupled to cable 14, reciprocating up-and-down movement of handle 40 operates the winch in the manner described below to quickly winch up the cable and extricate the person from the manhole.

As cable 14 is winch up, it is retracted within housing 16 by the normal operation of the fall prevention system 12. As is customary in situations illustrated in FIGS. *3a–b*, a co-worker or observer normally stands by the manhole, next to the tripod, to further the safety of the person entering the manhole and to effect quick extrication in the event of an emergency.

FIGS. *4a, b* and *c* illustrate the operational sequence of winch 10. In FIG. *4a*, cable 14 has been inserted into the respective cable guide channel 60 of the upper and lower gripping devices 42 and 44, handle 40 is at its lowest position, the cable is securely gripped by the gripping devices, each of the gripping jaw 54 being firmly biased against the cable located in the cable guide channel 60. As shown, the length of the connecting links 46 and 50 are unequal, to permit an appropriate separation between gripping devices 42 and 44 on slide bar 38. In the condition shown in FIG. *4a*, upper gripping device 42 is at the upper extent of its travel on slide bar 38, and lower gripping device 44 is correspondingly at its lowest travel on the slide bar.

In this orientation, the vertical straight edge 71 of kicker bar 66 rests on the housing 58 of upper gripping jaw 54, with horizontal straight edge 70 extending approximately one-eighth inch below the lower edge of the upper gripping jaw (FIG. 5). Roller 72 contacts the lower edge of housing 58, and handle 40 is in its down position. Cable 14 is securely gripped by both gripping devices 42 and 44.

Figure 4A:
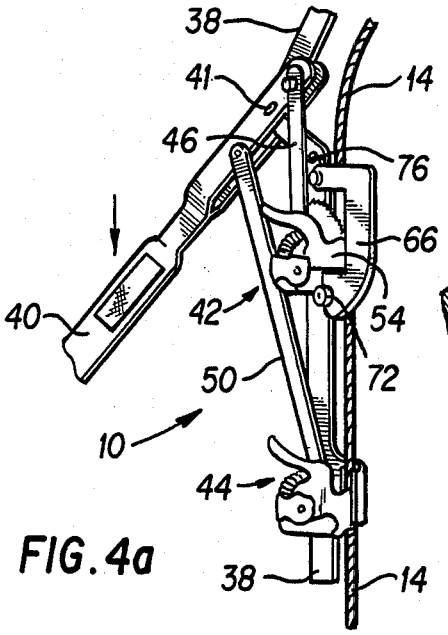
FIGS. 4*a*–4*c* illustrate the operation of the winch of the present invention.
Figure 4B:
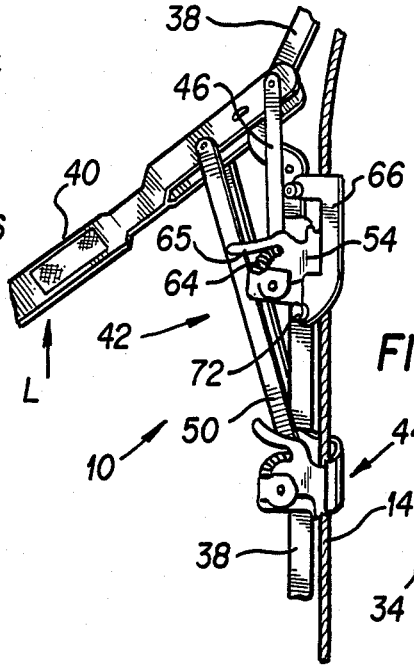
Figure 4C:
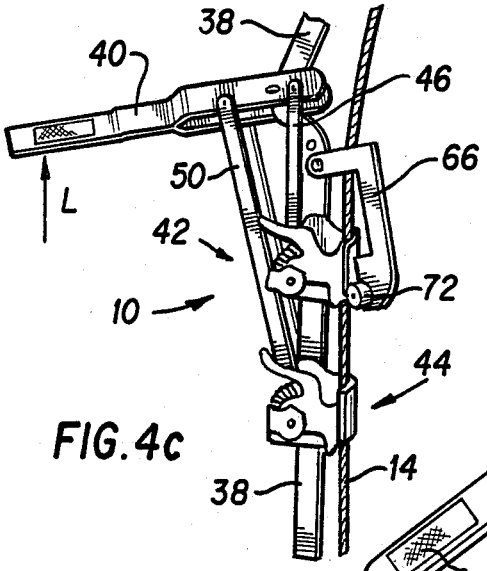

As the operator S begins to move the handle up, in the direction indicated by the arrow L (FIG. *4b*), the horizontal straight edge portion 70 of kicker bar 66 hooks onto and engages the lower edge of gripping jaw 54, and exerts an upward force to ensure the jaw's release from the cable, against the bias of spring 64. Once gripping jaw 54 is moving freely, roller 72 rides up on housing 58, thus lifting kicker bar 66 off the gripping jaw and allowing the full upward stroke of handle 40. During this movement, the lower gripping device 44 maintains its secure grip on cable 14, the upper device is in condition to release its grip on the cable, and as handle 40 is moved upwardly, the length of the cable above the lower gripping device is passed freely between gripping jaw 54 and cable guide channel 60 of the upper gripping device, as shown in FIG. 4c. The lower gripping device 44 has been lifted to the upper extent of its travel on slide bar 38 by handle 40 and links 50. On the other hand, rotation of handle 40 about pivot 41 has caused links 46 to push upper device 42 to the lowest point of its travel on the slide bar 38.

The cycle is completed by moving handle 40 down again, with roller 72 riding back down housing 58, allowing the horizontal straight 70 of kicker bar 66 to again drop into place below the lower surface of gripping jaw 54 as the handle reaches its lowest point (FIG. *4a*). During this downward movement, the kicker bar does not interfere with the secure gripping of the cable by gripping jaw 54 since roller 72 freely rotates on the outer surface of the gripping jaw (the surface visible in FIGS. *4a–c*). On the downward stroke of handle 40, downward movement of the lower gripping device 44 via connecting link 50 permits the gripping jaw of the lower gripping device to be rotated counter-clockwise, against the bias of the spring, by the relative movement between the gripping device and cable 14, thus permitting the lower gripping device to slide downwardly on the slide bar and cable, while the cable is securely held by the upper gripping device. At the lowest position of handle 40, the winch again assumes the orientation shown in FIG. *4a*, and the cycle is repeated to quickly winch up the cable.

It can be seen from the foregoing description that kicker bar 66 ensures the reliable performance of the gripping jaw 54 on the upper gripping device 42. It keeps gripping jaw 54 from jamming and possibly causing the cable to kink, which would otherwise cause the winch 10 to fail to reliably lift cable 14. Because upper gripping jaw 54 is positively lifted by kicker bar 66, winch 10 works even if the cable is dirty, kinked or damaged, thereby substantially increasing the reliability of the winch as a rescue device for persons trapped in confined spaces, such as the manhole 78 illustrated in the drawings.

It is understood that the sizes of the components and types of material used in the winch, the cable and the fall prevention system would be appropriately selected for the application requirements of the operating ambient conditions and the weights intended to be lifted. The kicker bar may be retrofitted into cable winching or pulling devices which are structured and operate as described above, and thus enhance the safety and reliability of the existing devices.

As noted above, winch 10 in no way affects the normal operation of the fall prevention system, and is only coupled to the cable of the system when it is necessary to lift the cable and to extricate the person in the event of an emergency. For illustration purposes, the cable may be galvanized or stainless steel aircraft-type cable having a diameter of 5 mm or 3/16 inch. For a winch capable of lifting 300 pounds, the winch will provide a mechanical advantage of 4:1 and a retrieval rate of approximately 20 feet/minute. For operating in and extricating a person from a confined space, it is intended that a full-body harness be worn by the person to which the cable is attached. Such harness will keep the body in an upright position to permit retrieval through the limited opening of the confined space.

The invention may be embodied in other specific form without departing from the spirit or essential characteristics as described herein. The foregoing described embodiment is therefore to be considered in all respects as illustrative, and not restrictive. The scope of the invention is defined by the appended claims, rather than by the foregoing description, and all changes which come within the meaning and range of equivalency of the claims are intended to be embraced therein.

What I claim is:

1. In combination with a cable and a cable winch of the type including a first and a second cable gripping assembly each movably disposed on a support member adapted to be secured at one end to a support, said first gripping assembly being disposed on said support member closest to the end to be secured to said support, each of said gripping assemblies having a rotatable cable engaging element biased into contact with a non-rotatable cable receiving element, an operating lever pivotally connected to said support member, and first and second links respectively coupling said first and second gripping assemblies to spaced locations on said operating lever such that reciprocating movement of said operating lever effects reciprocating movement of said gripping assemblies along said support member, towards and away from each other, said gripping assemblies alternately gripping the cable, transporting said cable as the gripping assembly is moved along said support member by the operating lever, and releasing the grip on the cable as the gripping assembly is moved in the reverse direction along said support member to grip another location on said cable, the improvement comprising:

a mechanism operatively associated with said first gripping assembly to effect rotation of said cable engaging element of said first assembly out of engagement with said cable, said mechanism comprising a shaped element having one end portion pivotally mounted on said support member adjacent to said first gripping assembly and a free end portion having an engaging portion adapted to engage and lift said cable engaging element of said first gripping assembly out of contact with said cable upon movement of said operating lever in the direction to move said second gripping assembly toward said first gripping assembly, said shaped member being supported to pivot relative to said support member but not to reciprocate relative to said support member.

2. A combination as defined in claim 1, wherein said shaped element further includes a rolling support means on said free end portion to permit free movement of said free end portion relative to said first gripping assembly.

3. A combination as defined in claim 2, wherein said rolling support comprises a roller element rotatably supported on said free end portion of said shaped member by support means to lift said engaging portion from said cable engaging element after said shaped member has moved a predetermined distance relative to said first gripping assembly.

4. A combination as defined in claim 3, wherein said support member has a portion configured into an S shape, and said first and second gripping assemblies are disposed below the configured portion.

5. A winching apparatus for winching a flexible, elongated element such as a cable, comprising:

a support member adapted to be secured at one end to a support;

a first and a second cable gripping assembly each slidably disposed on said suport member, said first gripping assembly being disposed on said support member closest to the end to be secured to said support, each of said gripping assemblies having a rotatable cable-engaging element biased into contact with a non-rotatable cable-receiving element;

an operating lever pivotally connected to said support member;

first and second links respectively coupling said first and second gripping assemblies to spaced locations on said operating lever such that reciprocating movement of said operating lever effects reciprocating movement of said gripping assemblies along said support member, towards and away from each other, said gripping assemblies alternately gripping the cable, transporting said cable as the gripping assembly is moved along said support member by the operating lever, and releasing the grip on the cable as the gripping assembly is moved in the reverse direction along said support member to grip another location on said cable; and a shaped element having one end portion pivotally mounted on said support member adjacent to said first gripping assembly and a free end portion having an engaging portion adapted to engage and lift said cable engaging element of said first gripping assembly out of contact with said cable to permit passage of said cable between said cable-engaging element and said cable-receiving element, upon movement of said operating lever in the direction to move said second gripping assembly toward said first gripping assembly, said shaped member being supported to pivot relative to said support member but not to reciprocate relative to said support member.

6. A winching apparatus as defined in claim 5, wherein said shaped element further includes a rolling support means on said free end portion to permit free movement of said free end portion relative to said first gripping assembly.

7. A winching apparatus as defined in claim 6, wherein said support means comprises a roller element rotatably supported on said shaped element and adapted to separate said engaging portion from said cable-engaging element after said first gripping assembly has been moved a predetermined distance relative to said shaped member.

8. A winching apparatus as defined in claim 7, wherein said support member has a portion configured into an S shape, and said first and second gripping assemblies are disposed below the configured portion.

9. A rescue apparatus for retrieving a person from a confined space, comprising, in combination:

a cable attached at one end to the person and secured at the other end to a cable tensioning and retracting device, said device being attached to a support and operating to lock the cable and prevent further cable payout in the event of a rapid extension of said cable above a predetermined speed;

a cable winch attached to said support and operatively associated with said cable to winch said cable toward said support, said winch including:

a support member adapted to be secured at one end to said support;

a first and a second cable gripping assembly each slidably mounted on said support member, said first gripping assembly being disposed on said support member closest to the end to be secured to said support, each of said gripping assemblies having a rotatable cable-engaging element biased into contact with a non-rotatable cable-receiving element;

an operating lever pivotally connected to said support first and second links respectively coupling said first and second gripping assemblies to spaced locations on said operating lever, on opposite sides of the connection point of said lever and said support member, such that reciprocating movement of said operating lever effects reciprocating movement of said gripping assemblies along said support member, towards and away from each other, said gripping assemblies alternately gripping the cable, transporting said cable toward said support as the gripping assembly is moved along said support member by the operating lever, and releasing the grip on the cable as the gripping assembly is moved in the reverse direction along said support member to grip another part of said cable; and a shaped element having one end portion pivotally mounted on said support member adjacent to said first gripping assembly and a free end portion having an engaging portion adapted to engage and lift said cable-engaging element of said first gripping assembly out of contact with said cable to permit passage of said cable between said cable-engaging element and said cable-receiving element, upon movement of said operating lever in the direction to move said second gripping assembly toward said first gripping assembly, said shaped member being supported to pivot relative to said support member but not to reciprocate relative to said support member, whereby reciprocating movement of said operating lever incrementally winches said cable toward said support, said shaped member coacting with said first gripping assembly to ensure positive separation of said cable-engaging element from said cable and said cable-receiving element.

10. A rescue apparatus as defined in claim 9, where said shaped element further includes a rotatable support means on said free end portion to permit free movement of said end portion relative to said first gripping assembly.

11. A rescue apparatus as defined in claim 10, wherein said rotatable support means comprises a roller element rotatably suported by support means to lift said engaging portion from said cable-engaging element after said shaped member has been moved a predetermined distance relative to said first gripping assembly.

12. A rescue apparatus as defined in claim 11, wherein said support member has a portion configured into an S shape, and said first and second gripping assemblies are mounted below the configured portion.

* * * * *